US005944875A

United States Patent [19]

Stencel et al.

[11] Patent Number: 5,944,875

[45] Date of Patent: Aug. 31, 1999

[54] TRIBOELECTRIC SEPARATOR WITH MIXING CHAMBER AND PRE-SEPARATOR

[75] Inventors: John M. Stencel, Versailles; John L. Schaefer, Lexington; Heng Ban, Lexington; James K. Neathery, Lexington; Tianxiang Li, Lexington, all of Ky.

[73] Assignee: University of Kentucky Research Foundation, Lexington, Ky.

[21] Appl. No.: 08/734,983

[22] Filed: Oct. 22, 1996

[51] Int. Cl.[6] ..... B03C 3/30

[52] U.S. Cl. ..... 95/57; 95/78; 96/17; 96/63; 209/127.1; 209/127.4

[58] Field of Search ..... 96/17, 60, 61, 96/63, 27; 209/127.1, 127.4; 95/57, 78

[56] References Cited

U.S. PATENT DOCUMENTS

| | | | |
|---|---|---|---|
| 1,071,354 | 8/1913 | Schnelle | 209/130 |
| 1,940,198 | 12/1933 | Wagner | 96/19 |

(List continued on next page.)

FOREIGN PATENT DOCUMENTS

| | | | |
|---|---|---|---|
| 489 249 | 1/1919 | France . | |
| 1036388 | 8/1983 | U.S.S.R. | 209/127.4 |

OTHER PUBLICATIONS

Whitlock; Electrostatic Separation of Unburned Carbon from Fly Ash; Proceedings, 10th International Ash Use Symposium 1993; 70–1–70–12.

Kelly; The Theory of Electrostatic Separations: A Review Part II. Particle Charging; Minerals Engineering; 1989; vol. 2, No. 2, 193–205.

Alfano et al; Applications of Static Electricity in Coal and Ore Benefication; Journal of Electrostatics; 1985; vol. 16 315–328.

Ciccu et al.; Selective Tribocharging of Particles for Separation; Kona Powder and Particle, 1993; No. 11; 5–15.

Ciccu et al.; Experimental Study on Triboelectric Charging of Mineral Particles; Journal of Electrostatics, 1989; vol. 23, 157–68.

Ciccu, G. et al.; Ore and Coal Processing with the Turbo-Charger Electrostatic Separator; Advances in Fine Particles Processing; 1990; pp. 427–439.

Stencel et al; Dry, Electrostatic Separation of Carbon from Coal Fly Ash; Second Conference on Unburned Carbonaceous Material on Utility Fly Ash; Mar. 5–6, 1996; 160–177.

Gibbins et al; The Origin of Unburn Carbon in Pulverised Fuel Ash; Int'l Conference on Coal Science; 1993; 35–39.

Inculet et al; Electrostatic Benefication of Coal; Electrostatics and ICS Applications, 1973; 87–131.

(List continued on next page.)

*Primary Examiner*—Richard L. Chiesa
*Attorney, Agent, or Firm*—King and Schickli

[57] ABSTRACT

A triboelectrostatic separation apparatus includes a mixing chamber having opposed first and second charging ports, a separator having a separation chamber, first and second electrodes, and a variable voltage source for applying respective positive and negative voltage potentials to the electrodes. First and second particle streams are delivered through the first and second charging ports resulting in the impingement of the particle streams upon each other within the mixing chamber, thus enhancing the electrostatic charging of the particles contained within the particle streams. The apparatus may also include a pre-separator having a pre-separation chamber, a charged particle collection chamber and a plurality of feed passageways providing fluid communication between the pre-separation and the charged particle collection chambers. As a result of imparting electrical charges upon the particles, an electric field exists within the pre-separator allowing certain particles to be repelled/drawn through the passageways into the charged particle collection chamber. A method for separating electrostatically charged particles is also described.

12 Claims, 1 Drawing Sheet

U.S. PATENT DOCUMENTS

| | | | |
|---|---|---|---|
| 3,273,317 | 9/1966 | Vicard | 96/17 |
| 3,493,109 | 2/1970 | Carta et al. | 209/11 |
| 3,655,550 | 4/1972 | Davies | 204/665 |
| 3,926,587 | 12/1975 | Squires | 55/479 X |
| 3,941,685 | 3/1976 | Singewald et al. | 209/9 |
| 4,319,890 | 3/1982 | Teller et al. | 55/463 X |
| 4,354,858 | 10/1982 | Kumar et al. | 95/78 |
| 4,478,613 | 10/1984 | Brettschneider et al. | 60/311 X |
| 4,557,827 | 12/1985 | Fricke et al. | 209/127.4 |
| 4,570,861 | 2/1986 | Zentgraf et al. | 209/127.1 X |
| 4,839,032 | 6/1989 | Whitlock | 209/11 X |
| 4,844,349 | 7/1989 | Kanda et al. | 241/19 |
| 4,874,507 | 10/1989 | Whitlock | 209/11 |
| 5,275,631 | 1/1994 | Brown et al. | 44/631 |
| 5,289,922 | 3/1994 | Inculet et al. | 209/127.1 |

OTHER PUBLICATIONS

Robl, et al.; Influence of Conversion to Low . . . Mineralogy: A Case on Fly Ash Petrology and Mineralogy: A Case Study; 12th International Pitts Coal Conference; 1995; 121–125.

Ban et al; Dry Triboelectrostatic Benefication of Fly Ash; Proceedings, International Ash Utilization Symposium, Oct. 23–25, 1996; Lexington, Kentucky.

TRIBOELECTRIC SEPARATOR WITH MIXING CHAMBER AND PRE-SEPARATOR

TECHNICAL FIELD

The present invention relates generally to the field of material separation and, more particularly, to an apparatus and method for electrostatically separating two species of particles present in a raw feedstock.

BACKGROUND OF THE INVENTION

The concept of electrostatic separation is well known in the art. For example, in U.S. Pat. No. 3,493,109 to Carta et al. ore particles are charged by triboelectricity. The Carta et al. separator includes a tangentially arranged inlet duct for feeding ore particles into a cyclone. The inner surface of the cyclone is coated with special materials. The dielectric constant or surface work function of these materials is intermediate that of the two species of particles to be separated.

More particularly, physical contact and friction between the particles themselves and the coated inner surface of the separator produces charges of opposite polarity on the two species of particles to be separated. The charged particles are then delivered from the cyclone to a separation chamber including opposing electrodes of opposite polarity. An electric field results which tends to draw the charged particles apart thereby completing the separation process.

Other examples of the electrostatic separation process are disclosed in, for example, U.S. Pat. Nos. 4,482,351 to Kitazawa et al.; 3,941,685 to Singewald et al.; 5,275,631 to Brown et al.; 5,332,562 to Kersey et al. and 5,224,604 to Duczmal et al.

While all of these known apparatus and processes provide for separation of selected particles, it should be appreciated that improvements are still possible. More specifically, prior art apparatus and methods for electrostatic separation of particles generally rely primarily on particle-wall contact to establish the differential charge on the particle surfaces, while only secondarily relying on the incidental particle-particle contact to further aid in establishing the differential charging. This tends to lead to significant wall erosion and substantially shortens the maintenance intervals between wall replacements: generally, a relatively expensive and somewhat time consuming repair.

Further, prior art approaches generally suffer substantial inefficiencies resulting from failure to take full advantage of the separating capabilities created by imparting differing charges on particles to be separated. Accordingly, a need is identified for an improved apparatus and method.

SUMMARY OF THE INVENTION

Accordingly, it is a primary object of the present invention to provide an improved apparatus and method for triboelectrostatic separation of two species of particles present in a raw feedstock where those two particle species have differing dielectric constants or work functions.

Another object of the present invention is to provide an apparatus and method for triboelectrostatic separation of particles that effectively optimize particle-particle contact during the imparting of a differential charge on the particle surfaces.

Still another object of the present invention is to provide an apparatus and method for triboelectrostatic separation of particles that effectively maximizes the separating capabilities which exist from imparting differential charges on the particles and the resulting electric field that is created by differentially charging the particles. Advantageously, this is done while minimizing the erosion effect on the walls of the particle charging portion of the apparatus, thereby significantly enhancing the service life of the apparatus between maintenance operations.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved triboelectrostatic separation apparatus is provided. The apparatus includes a mixing chamber having opposed first and second charging ports. Specifically, first and second particle streams are delivered through the first and second charging ports, respectively, into the mixing chamber so that the first and second particle streams impinge directly upon each other. The particle stream impingement allows for the particles contained within the streams to be tribocharged, i.e. establishing a differential charge on the particle surfaces by the action of the particle-particle contacts. Of course, it should also be appreciated that additional particle streams may be introduced into the mixing chamber, by providing additional charging ports, resulting in the impingement of the multiple particle streams upon each other.

The apparatus further includes a separator in communication with the mixing chamber for receiving the electrically charged particles to be separated. More specifically, the separator includes a separation chamber having a first electrode for attracting negatively charged particles and a second electrode for attracting positively charged particles. Additionally, the separation chamber includes a first outlet for discharging negatively charged particles electrostatically drawn towards the first electrode, as well as, a second outlet for discharging positively charged particles electrostatically drawn toward the second electrode.

The apparatus also includes a variable voltage source. The variable voltage source applies a positive voltage potential to the first electrode and a negative voltage potential to a second electrode so as to establish an electric field for the electrostatic separation of particles within the separation chamber in the manner described.

Further, the apparatus also includes first and second pneumatic eductors for receiving the raw feedstock containing the particles to be separated. More specifically, these particles are delivered to the first and second eductors and accelerated by a driving fluid, such as, air or other dry, gaseous medium. The driving fluid conveys the particles through first and second feed lines, thus, establishing the first and second particle streams. Preferably, the first and second feed lines are constructed from or lined with a dielectric material having a dielectric constant or work function intermediate to the two species of particles desired to be separated. As a result of particle-feed line wall contact, the particles are electrically charged prior to delivery to the mixing chamber.

In addition, the particle-particle contact within the first and second feed lines also aids in the electrical charging of the particles. Advantageously, the impinging of the first and second particle streams within the mixing chamber still more significantly enhances and promotes the electrical charging of the particles.

In accordance with another aspect of the present invention, the apparatus may also include a pre-separator. Specifically, the pre-separator is preferably positioned between the mixing chamber and the inlet of the separator. The pre-separator includes a wall defining a pre-separation chamber, a charged particle collection chamber and a plurality of feed passageways providing fluid communication between the pre-separation chamber and the charged particle collection chamber. Advantageously, the pre-separator takes full advantage of the electric field resulting from the flow of charged particles through it so as to maximize separation efficiency. More particularly, particles consisting of the majority constituent establish an electric field perpendicular to the axis of symmetry of the pre-separator chamber and, because of their polarity, are repelled toward the wall and drawn through the feed passageways into the charged particle collection chamber. Accordingly, a portion of the particles are separated prior to entering the separator, thereby, significantly enhancing particle separation efficiency.

In accordance with still another aspect of the present invention, the apparatus includes a means for recovering the charged particles from the charged particle collection chamber following pre-separation. Preferably, the means for recovering the charged particles includes an appropriate particle collection device known in the art, such as, for example, a bag house or bag filter. Of course, in order to further enhance recovery of the charged particles from the charged particle collection chamber, the apparatus may also include one or more induced draft fans downstream from the charged particle collection chamber. These fans function to produce a negative pressure to draw the charged particles from the pre-separation chamber through the feed passageways into the charged particle collection chamber and ultimately, to the recovering means. Preferably, the feed passageways have a diameter of between substantially 10 $\mu$m–50,000 $\mu$m; that is, in the range of 10–100 times the diameter of the largest charged particles to be separated, thereby, allowing the charged particles to be efficiently drawn through the feed passageways into the charged particle collection chamber.

Alternatively, the apparatus of the present invention may include the pre-separator in combination with the separator without utilizing the mixing chamber. The pre-separator would include an opening for receiving electrically charged particles to be separated. This arrangement would rely solely on the particle-feed line wall contact and the particle-particle contact within the feed line to impart the differential electrical charges upon the particles. Otherwise, the pre-separator is structurally and functionally the same as previously described.

In accordance with yet another aspect of the present invention, a method is provided for separating electrostatically charged particles. The method includes the step of feeding first and second particle streams into a mixing chamber so that the first and second particle streams impinge upon each other. As described above, the impingement of the particle streams enhances the electrical charging of the particles contained within the streams as a result of the increased particle-particle contact.

This step is followed by the delivering of the electrically charged particles to a separation chamber. As described above, the separation chamber includes a positive electrode for attracting negatively charged particles and a negative electrode for attracting positively charged particles.

More specifically describing the method, the first and second particle streams are fed into the mixing chamber at a velocity in the range of 2–100 meters/ second. Advantageously, impinging the gas streams upon each other at a velocity within the stated range promotes differential charging of the impinging particles contained within the particle stream as a result of the particle-particle contact. In addition, the first and second gas streams preferably have a particle to gas mass ratio in the range of 10:1–1:1000. More preferably, the particle to gas mass ratio is 1:1.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Figure 1:
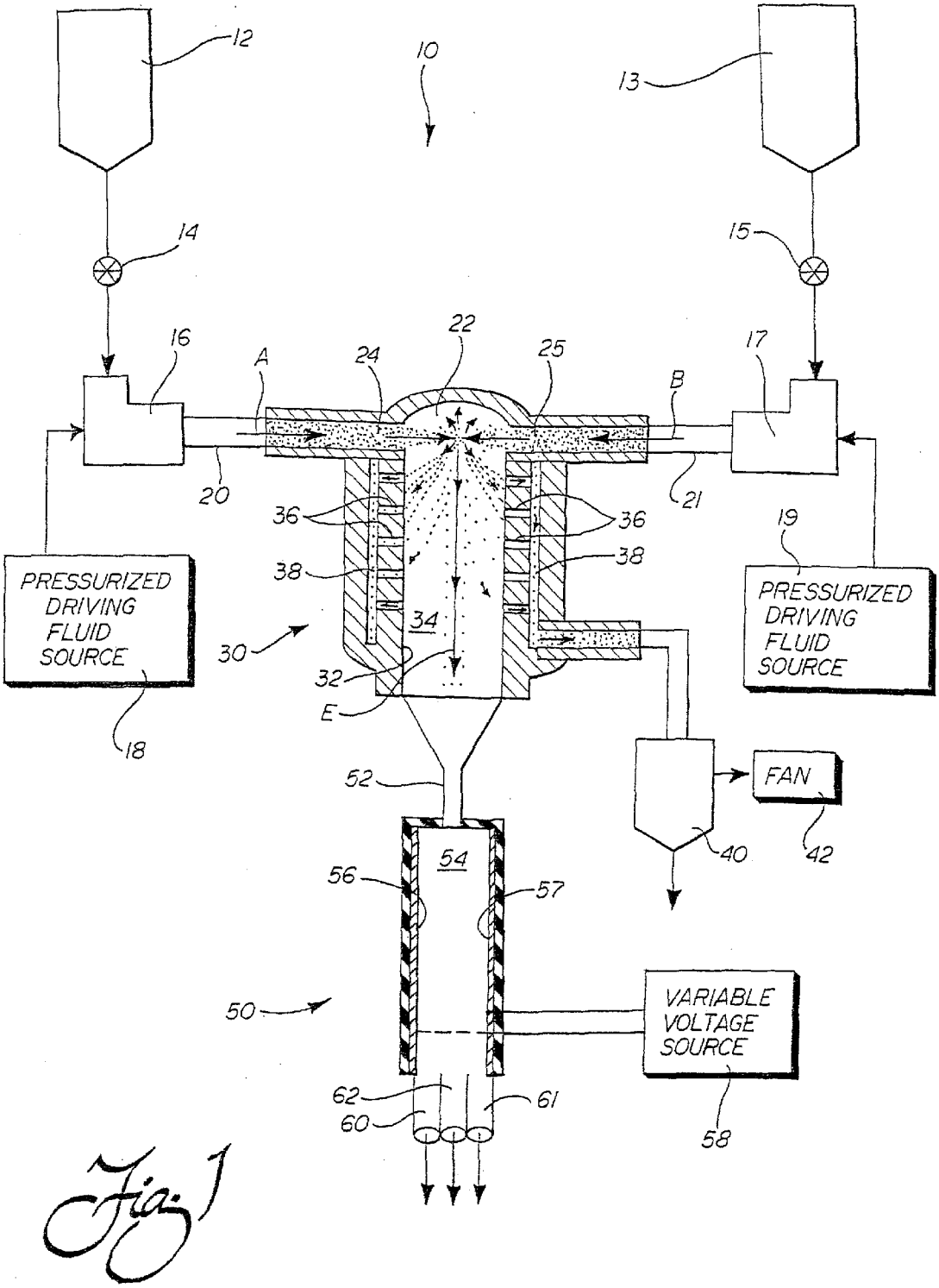
FIG. 1 is a partially schematical and sectional view of the triboelectrostatic separation apparatus of the present invention.

Reference will now be made in detail to the present preferred embodiment of the invention, an example of which is illustrated in the accompanying drawing.

DETAILED DESCRIPTION OF THE INVENTION

Reference will now be made to FIG. 1 schematically showing the triboelectrostatic separation apparatus 10 of the present invention. Such an apparatus 10 may be utilized in a method of separating two species of particles present in a raw feedstock. For example, the apparatus 10 may be utilized in the separation and purification of the mineral matter or pyrite constituents from the carbon constituents in finely-ground or sized coal; ash constituents from carbon in coal combustion ash; specific minerals obtained from fine-sized mineral mixtures; heavy metal or radioactive components which are physically mixed in soils or other materials; ceramic or inorganic impurities in powdered alloys; and ceramics contained in mixtures of ceramics, metals or organic polymers. In all cases, the terms "fine sized" or "finely ground" refer to particles having physical diameters in the range of 500 $\mu$m to approximately 0 $\mu$m and preferably, a diameter smaller than 75 $\mu$m. It should be appreciated that the apparatus 10 is used for separating dry particles in contrast to wet particles or wet separation systems in which water or some other liquid with or without water is used to effect particle separation and purification.

As shown in FIG. 1, the raw feedstock including the particles to be separated is contained in surge bins 12, 13. The raw feedstock is fed from the surge bins 12, 13 under the control of outlet valves 14, 15 into the pneumatic eductors 16, 17, respectively. Preferably, the control valves 14, 15 are star valves, volumetric feeders, mass weigh belts or other appropriate mass flow controllers of a type known in the art.

As should be appreciated, the pneumatic eductors 16, 17 are also operatively connected in fluid communication with pressurized driving fluid sources 18, 19, such as high pressure air pumps. The driving fluid is preferably air although other gases such as nitrogen, helium, argon, carbon dioxide or combustion flue gas may be utilized at ambient temperature or even at temperatures as high as 1000° C. As the raw material mixes with the driving fluid in the pneumatic eductors 16, 17, the raw material is accelerated and conveyed by the driving fluid through feed lines 20, 21. The acceleration of the raw material, and more particularly, the particles which comprise the raw material, by the driving fluid results in the establishment of particle streams A, B within feed lines 20, 21, respectively.

Preferably, feed lines 20, 21 are constructed along a straight path as shown. In this way, particle-wall collisions are generally limited to low incident angles with particles only lightly skimming the wall. This transfers charge while minimizing wall erosion resulting from particle abrasion. Accordingly, the service life of the feed lines 20, 21 is significantly extended.

Of course, it should be appreciated that the feed line 20, 21 may include bends if desired or as made necessary due to physical limitations of the processing site. In all events no or only a minimal number of sharp bends (approximately 90°) are to be utilized. Of course, under any circumstances the feed lines 20, 21 are constructed from or aligned with a wear resistant dielectrical material having a dielectric constant or work function intermediate the two species of particles contained within the raw material which are to be separated. The material may be chosen in order to selectively charge one of the species of particles to be separated while minimizing the charge of the other species or selectively charge both of the species to be separated with different polarities.

Generally, the material selected for feed lines 20, 21 may be selected from a group consisting of metal including hardened steels and specialty alloys, ceramic, plastic and mixtures thereof. Specific materials may, for example, be selected from a group such as copper, stainless steel, polytetraflorethylene, polytetraethylene, polypropylene, silica, alumina, iron, cobalt, nickel, tungsten, molybdenum, titanium, aluminum, zirconium, iron oxide, iron (II) oxide, iron (III) oxide, cobalt (II) oxide, cobalt (III) oxide, nickel monoxide, tungsten dioxide, tungsten trioxide, tungsten pentoxide, molybdenum dioxide, molybdenum trioxide, molybdenum pentoxide, molybdenum sesquaoxide, titanium monoxide, titanium dioxide, titanium sesquaoxide, aluminum oxide, zirconium oxide, polyvinylchloride, polyurethane and mixtures thereof. Alloys of the listed metals may also be utilized and, of course, it should be appreciated that this list of materials is illustrative and not exhaustive.

As shown in FIG. 1, feed lines 20, 21 communicate between pneumatic eductors 16, 17 and a mixing chamber 22. More specifically, feed lines 20, 21 deliver particle streams A, B to a first charging port 24 and a second, opposed charging port 25, respectively. First and second charging ports 24, 25 are shown diametrically opposed in FIG. 1. Of course, this results in particle streams A, B being impinged directly upon each other within mixing chamber 22.

Advantageously, the direct impingement of particle streams A, B promotes and enhances differential charging of the impinging particles as a consequence of particle-particle contact. As previously described, feed lines 20, 21 preferably include no or a minimal number of sharp bends. Thus, rather than rely mainly on particle-feed line wall contact to impart the differential charge upon the particles to be separated, the direct impingement of particle streams A, B maximizes the particle-particle contact as a means for imparting the differential charge. It should be appreciated that this allows one to provide the desired and necessary differential charge to the particles in order to achieve separation while also advantageously allowing one to minimize particle-feed line wall contact so as to reduce wear upon the walls of the feed lines 20, 21 due to the erosive nature of such contact.

Feed lines 20, 21 are sized to handle solid flow rates that are determined by the capacity of the apparatus 10. The solid/gas mass ratio in feed lines 20, 21 is preferably 1:1 although values of this ratio between 10:1–1:1000 may be utilized. In addition, the velocity of opposing particle streams A, B is preferably between 2–100 meters/second. Of course, the higher velocity, the greater the charging of the gas entrained particles by tribocharging. Further, the flow in feed lines 20, 21 is required to be turbulent with Reynolds number, $R_e$ >2300 (where $R_e$ =DV/ν, where D=particle diameter, V=fluid flow velocity, and ν=kinetic viscosity of fluid).

Of course, the particles which are fed from surge bins 12, 13 into pneumatic eductors 16, 17 so as to establish particle streams A, B could be fed from a single surge bin into a single pneumatic eductor with a split feed line leading to first and second charging ports 24, 25 of the mixing chamber 22. Furthermore, additional feed lines/charging ports/particle streams could be introduced into mixing chamber 22 so that all particle streams are impinged upon each other resulting in increased tribocharging action as a result of particle-particle contact. Thus, it should be appreciated that the preferred embodiment, as shown in FIG. 1, having two particle streams A, B is provided for illustrative purposes only and the concept of the present invention should not be considered as limited thereto.

As shown in FIG. 1, the apparatus 10 of the present invention may also include a pre-separator, generally designated by reference numeral 30. The pre-separator 30 is in fluid communication with mixing chamber 22 and includes a wall 32 defining a pre-separation chamber 34. Feed passageways 36 are provided through wall 32 so as to provide fluid communication between the pre-separation chamber 34 and an annular, concentrically disposed charged particle collection chamber 38.

The pre-separator is provided so as to maximize the separating capabilities which exist from imparting differential charges upon particles and the resulting electric field that is established by the charged particles. This allows for a portion of the charged particles to be separated prior to entering the separator of apparatus 10, which will be described in more detail below.

As already stated, as a result of the impinging of particle streams A, B, as well as from the particle-feed line wall contact, the particles are differentially charged. More specifically, certain particles receive a positive charge while other particles receive a negative charge. Of course, the two types of particles being separated are almost always present in different relative concentrations. Thus, dependent upon the composition of the raw feedstock being separated following tribocharging the majority of particles may have a positive charge and a minority of particles a negative charge or vice versa.

The establishment of the differential charge on the particles results in an electric field perpendicular to the axis of symmetry of pre-separation chamber 34, as designated by reference letter E. Consequently, it is possible to effect separation of the charged particles by the action of the electric field E established by the flow of charged particles.

More specifically, a charged particle moving through the pre-separation chamber 34 at any location except along the axis of symmetry of the pre-separation chamber will experience either a repulsive or attractive force from the axis as a consequence of the electric field E. Repulsion of the charged particles from electric field E is a consequence of the polarity of the repelled particles being identical to that of the majority of charged particles, whereas attraction towards the electric field E would be a consequence of the polarity being opposite of the majority of particles. Accordingly, it can be appreciated that the pre-separator 30 of the present invention is designed so as to remove the majority particles which are repelled from the electric field E.

The particles that are repelled from electric field E are repulsed towards the wall 32 of pre-separation chamber 34. These particles then pass through feed passageways 36 into the charged particle collection chamber 38. Preferably, the feed passageways 36 have a diameter of between substantially 10 $\mu$m–50,000 $\mu$m which is approximately 10–100 times the diameter of the largest charged particles to be separated. This allows for a portion of the particles to be separated within pre-separator 30 prior to being delivered to the separator.

Once the charged particles have entered the charged particle collection chamber 38, a means 40 for recovering the charged particles is provided. The recovery means 40 may be, for example, a bag house or bag filter. It should be appreciated, however, that other appropriate particulate cleanup equipment of any type known in the art may be utilized.

An induced draft fan 42 is operatively connected to the recovery means 40. The induced draft fan 42 functions to create a gas flow for drawing the charged particles through feed passageways 36 into the charged particle collection chamber 38 and then onto the recovery means 40. The flow and pressure drop created by induced draft fan 42 along with the flow rate of particle streams A, B dictate the number of feed passageways 36 which are constructed in wall 32. By determining the number of feed passageways 36 in this manner, pre-separation efficiency is maximized without jeopardizing the integrity of the process by allowing any and all particles to be drawn to the feed passageways.

Preferably, pre-separation chamber 34 has a cylindrical shape. The geometrical shape of pre-separation chamber 34 is important so as to impart less turbulence in the gas/particle flow than is present within feed lines 20, 21 and mixing chamber 22. Thus, it is possible to decrease that turbulence by increasing the cross sectional area through which the charged particles flow relative to the cross sectional area within feeder lines 20, 21. Accordingly, the velocity of the charged particles within pre-separator 30, and more particularly within pre-separation chamber 34 is preferably in the range of 1–50 meters/second or about one half of the particle velocity present in the feed lines 20, 21.

With further reference to FIG. 1, there is shown a separator, generally designated by reference numeral 50, for use in conjunction with apparatus 10. The separator 50 is positioned downstream from the pre-separator 30 and includes an inlet 52 for receiving the charged particles to be electrostatically separated. The separator 50 also includes a separation chamber 54 which effectively defines the particle separation zone. Here, positive and negative particles are acted upon by an applied electric field established across parallel plates or electrodes 56, 57 located on opposite sides of the chamber 54. More specifically, the first electrode 56 is provided for attracting negatively charged particles while the second electrode 57 is provided for attracting positively charged particles. Accordingly, the first and second electrodes 56, 57 are connected to a variable voltage source 58 which applies a positive voltage potential to the first electrode 56 and a negative voltage potential to second electrode 57.

As should further be appreciated from viewing FIG. 1, separator 50 includes a first outlet 60 longitudinally aligned with the first electrode 56 for discharging negatively charged particles electrostatically drawn toward the first electrode. Additionally, the separator 50 includes a second outlet 61 longitudinally aligned with the second electrode 57 for discharging positively charged particles electrostatically drawn towards the second electrode. Further, in certain embodiments, the separator 50 may include a third intermediate outlet 62 longitudinally aligned with the separation chamber 54. This outlet 62 discharges unseparated particles that may be recycled through the apparatus if desired.

It should be recognized that the separator 50, as shown in FIG. 1 and as described above, is presented for illustrative purposes only and the invention should not be considered to be limited to this specific design. For example, the separator 50 may be of the type as shown and described in pending application Ser. No. 08/726,255 filed Oct. 4, 1996, and entitled "Apparatus and Method for Triboelectrostatic Separation" the full disclosure of which is hereby fully incorporated by reference.

In accordance with the method of the present invention the particles to be separated are fed from surge bins 12, 13 through valves 14, 15 into pneumatic eductors 16, 17. The particles are introduced into feed lines 20, 21 along with a driving fluid so as to establish particles steams A, B. The particle streams A, B are then delivered into mixing chamber 22 through opposed first and second charging ports 24, 25, respectively. Particle streams A, B are preferably introduced into the mixing chamber 22 at a velocity in the range of 2–100 meters/second.

Advantageously, charging ports 24, 25 are diametrically opposed, thus, causing particle streams A, B to be impinged upon each other. The impinging results in increased particle-particle contact for electrostatically charging the particles to be separated. As should be appreciated, there is less emphasis placed upon the charging which takes place during the particle-feed line wall contact and the particle-particle contact within feed lines 20, 21. This in turn decreases the wear on feed lines as a result of the decreased particle-feed line wall contact.

The method may also include the step of delivering the now electrically charged particles to a pre-separator 30 and/or a separator 50, as described above. More particularly, the pre-separator 30 maximizes separation efficiency by taking advantage of an electric field E which is established as a result of the electrostatic charging of the particles. Further, the separator 50 includes a separation chamber 54 having a first electrode 56 with positive voltage potential for attracting negatively charged particles and a second electrode 57 with negative voltage potential for attracting the positively charged particles.

In summary, numerous benefits result from employing the concepts of the present invention. More specifically, as a result of impinging particle streams A, B within mixing chamber 22, the electrostatic charging of the particles is enhanced as a consequence of the particle-particle contact at an accelerated velocity. This increased particle velocity is relatively easily maintained by providing straight feed lines without bends. Advantageously, less reliance is placed upon the particle-feed line wall contact resulting in less wear and erosion on the feed lines 20, 21 and hence, a longer service life for apparatus 10.

Additionally, the inclusion of a pre-separator 30 positioned between mixing chamber 22 and separator 50 further enhance the separating capabilities of the apparatus. It should be appreciated that the pre-separator 30 takes full advantage of the electric field E which occurs within the pre-separator as a result of imparting differential charges on the particles to be separated and passing the particles through the pre-separator. As a result of the novel concepts which are employed, separation efficiency is enhanced and particle separation is optimized.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the pre-separator 30 may be used in conjunction with separator 50 or in a similar type separator means known in the art, without utilizing the impinging particle streams and mixing chamber 22. This particular alternative arrangement may only include a single particle stream being introduced into the pre-separator and total reliance being placed upon the particle-feed line wall contact and particle-particle contact within the feed line as a way of imparting the differential charge on the particles. Furthermore, it is also possible to employ the impinging particle streams and mixing chamber 22 in conjunction with the separator 50, or any other separator design known in the art without the use of pre-separator 30.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A triboelectrostatic separation apparatus, comprising:

a mixing chamber with opposed first and second charging ports for feeding respective first and second particle streams into said mixing chamber so that said first and second particle streams impinge thereby electrically charging particles contained in said first and second particle streams;

a separator including an inlet for receiving the electrically charged particles to be separated, a separation chamber, a first electrode for attracting negatively charged particles, a second electrode for attracting positively charged particles, a first outlet for discharging negatively charged particles electrostatically drawn toward said first electrode and a second outlet for discharging positively charged particles electrostatically drawn toward said second electrode; and a variable voltage source for applying a positive voltage potential to said first electrode and a negative voltage potential to said second electrode.

2. The triboelectrostatic separation apparatus set forth in claim 1, further including first and second pneumatic eductors wherein said first and second particle streams are accelerated by a driving fluid within first and second feed lines, said first and second feed lines providing fluid communication between said first and second pneumatic eductors and said first and second charging ports, respectively.

3. The triboelectrostatic separation apparatus set forth in claim 1, further including a pre-separator positioned between said mixing chamber and said separator inlet, said pre-separator including a wall defining a pre-separation chamber, a charged particle collection chamber, and a plurality of feed passageways providing fluid communication between said pre-separation and charged particle collection chambers whereby charged particles repelled/drawn toward said wall pass through said feed passageways and enter said charged particle collection chamber.

4. The triboelectrostatic separation apparatus set forth in claim 3, further including means for recovering the charged particles from the charged particle collection chamber following pre-separation.

5. The triboelectrostatic separation apparatus set forth in claim 4, further including an induced draft fan downstream from the charged particle collection chamber so as to produce a negative pressure to draw the charged particles through said feed passageways into the charged particle collection chamber.

6. The triboelectrostatic separation apparatus set forth in claim 5, wherein said feed passageways have a diameter substantially between 10 $\mu$m–50,000 $\mu$m.

7. A triboelectrostatic separation apparatus, comprising:

a pre-separator including an opening for receiving electrically charged particles to be separated, a wall defining a pre-separation chamber, a charged particle collection chamber, a plurality of feed passageways providing fluid communication between said pre-separation and charged particle collection chambers and an induced draft fan downstream from said charged particle collection chamber so as to produce a negative pressure to draw the charged particles through said feed passageways into said charged particle collection chamber;

a separator including an inlet in communication with said pre-separator for receiving the electrically charged particles to be separated, a separation chamber, a first electrode for attracting negatively charged particles, a second electrode for attracting positively charged particles, a first outlet for discharging negatively charged particles electrostatically drawn toward said first electrode and a second outlet for discharging positively charged particles electrostatically drawn toward said second electrode; and a variable voltage source for applying a positive voltage potential to said first electrode and a negative voltage potential to said second electrode.

8. The triboelectrostatic separation apparatus set forth in claim 7, further including means for recovering the charged particles from the charged particle collection chamber following pre-separation.

9. The triboelectrostatic separation apparatus set forth in claim 7, wherein said feed passageways have a diameter substantially between 10 $\mu$m–50,000 $\mu$m.

10. A method for separating electrostatically charged particles, comprising:

feeding opposed first and second particle streams into a mixing chamber so that said first and second particle streams impinge so as to electrically charge particles contained in said first and second particle streams; and delivering the electrically charged particles to a separation chamber including a positive electrode for attracting negatively charged particles and a negative electrode for attracting positively charged particles.

11. The method set forth in claim 10, wherein said first and second gas streams are fed into said mixing chamber at a velocity in the range of 2–100meters/second.

12. The method set forth in claim 11, wherein said first and second gas streams have a particle to gas mass ratio in the range of 10:1 to 1:1000.

* * * * *